US006398304B1

(12) United States Patent
Chen et al.

(10) Patent No.: US 6,398,304 B1
(45) Date of Patent: Jun. 4, 2002

(54) HIGHCHAIR WITH AN IMPROVED SEAT ANGLE ADJUSTMENT MECHANISM

(75) Inventors: Er-Jui Chen, Kaohsiung; Hung-Chung Hou, Chia-Hsien; Hsiu-Chiang Liang, Ping-Tung Hsien, all of (TW)

(73) Assignee: Link Treasure Limited, Tortola (VG)

( * ) Notice: Subject to any disclaimer, the term of this patent is extended or adjusted under 35 U.S.C. 154(b) by 0 days.

(21) Appl. No.: 09/650,460

(22) Filed: Aug. 28, 2000

(51) Int. Cl.[7] ..... A47C 1/06
(52) U.S. Cl. ..... 297/327
(58) Field of Search ..... 297/327, 328

(56) References Cited

U.S. PATENT DOCUMENTS 278,241 A * 5/1883 Krill
5,669,664 A * 9/1997 Perego
5,676,424 A * 10/1997 Winkelhake
5,746,478 A * 5/1998 Lumley et al.
6,033,020 A * 3/2000 Ito
6,089,653 A * 7/2000 Hotaling et al.

* cited by examiner

*Primary Examiner*—Milton Nelson, Jr.
(74) *Attorney, Agent, or Firm*—W. Wayne Liauh

(57) ABSTRACT

An angle adjustment mechanism for seat of highchair. The highchair comprises a frame and a seat pivotably secured to frame. The angle adjustment mechanism comprises a positioner having a plurality of notches and a latched member. In a locked position, seat is immovably secured to frame with the latched member engaged with the notch of positioner. In adjusting the angle of seat, actuate the latched member to disengage from the notch of the positioner, thereby pivotably moving the seat for changing the angle thereof, and release the latched member to engage with the notch of the positioners again, thus locking seat in that angle.

18 Claims, 7 Drawing Sheets

HIGHCHAIR WITH AN IMPROVED SEAT ANGLE ADJUSTMENT MECHANISM

BACKGROUND OF THE INVENTION

1. Field of Invention

The present invention relates to a highchair and more particularly to an angle adjustment mechanism for seat of highchair.

2. Related Art

Conventionally, a highchair is designed to provide a convenient means to feed a baby by parents. A conventional highchair comprises a seat for permitting a baby to sit and four legs for supporting the seat. A number of prior art highchairs are found such as Taiwanese Patent Publication Nos. 369,862 and 269,141, U.S. Pat. No. 5,087,097 and 5,348,374, and German Patent Publication DE 4,429,573. These prior art generally disclose a highchair having a coupled seat which is at a fixed vertical height, or a highchair having an adjustable seat. However, none of above prior art highchairs discloses a highchair having an oblique angle adjustment seat. It is found by the inventor that a slightly oblique seat is preferred for baby while dining.

Various designs for performing an angle adjustment of seat have been located in a search such as Taiwanese Patent Publication Nos. 318,358 entitled "Improved angle adjustment mechanism for seat of highchair", 329,129 entitled "Highchair with angle adjustable seat". These prior art generally disclose a seat angle adjustment mechanism disposed in the arms. As such, it requires a precise configuration to effect a desired angle adjustment of seat. Further, such angle adjustment mechanisms inevitably complicate the structure of arm.

SUMMARY OF THE INVENTION

It is therefore an object of the present invention to provide an oblique angle adjustment mechanism for seat of highchair. The highchair comprises a frame and a seat pivotably secured to frame. The oblique angle adjustment mechanism comprises a positioner including an arcuate notched member having a plurality of notches; a base; a guide member; a latched member being positioned in a locked position or an operating position; an elastic member; and a control member attached to the latched member for controlling the movement of the latched member; wherein in a locked position, seat is immovably secured to frame with the latched member engaged with the notch of the positioner, and in adjusting the angle of seat, actuate the control member to cause the latched member to disengage from the notch of the positioner, thereby pivotably moving the seat for changing the angle thereof, and release the latched member to engage with the notch of the positioners again, thus locking seat in that angle.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become fully understood from the detailed description given hereinbelow illustration only, and thus are not limitative of the present invention, and wherein.

DETAILED DESCRIPTION OF THE INVENTION

Figure 1:
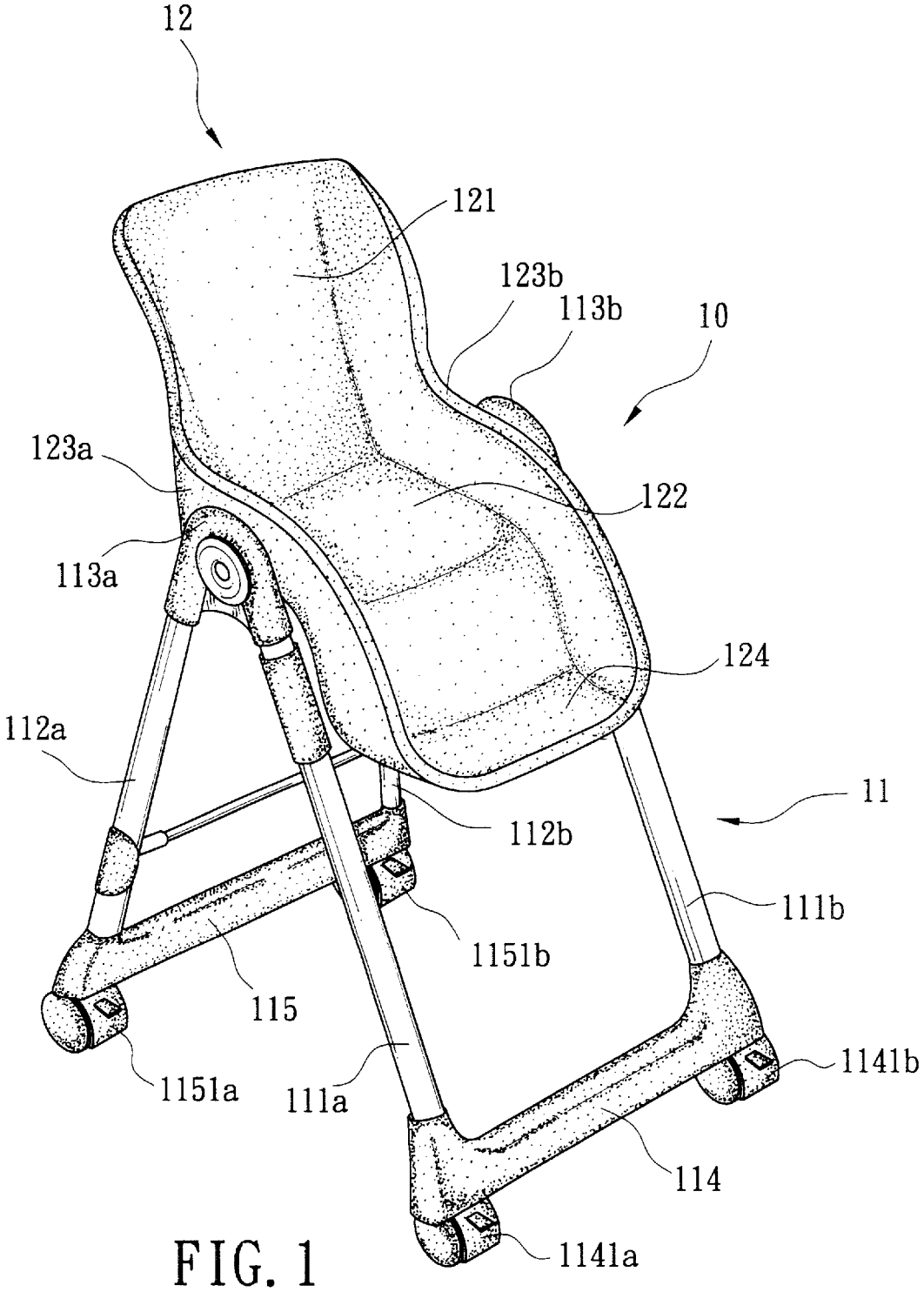
FIG. 1 is a perspective view of a highchair incorporating an oblique angle adjustment mechanism of a first preferred embodiment according to the invention.
Figure 2:
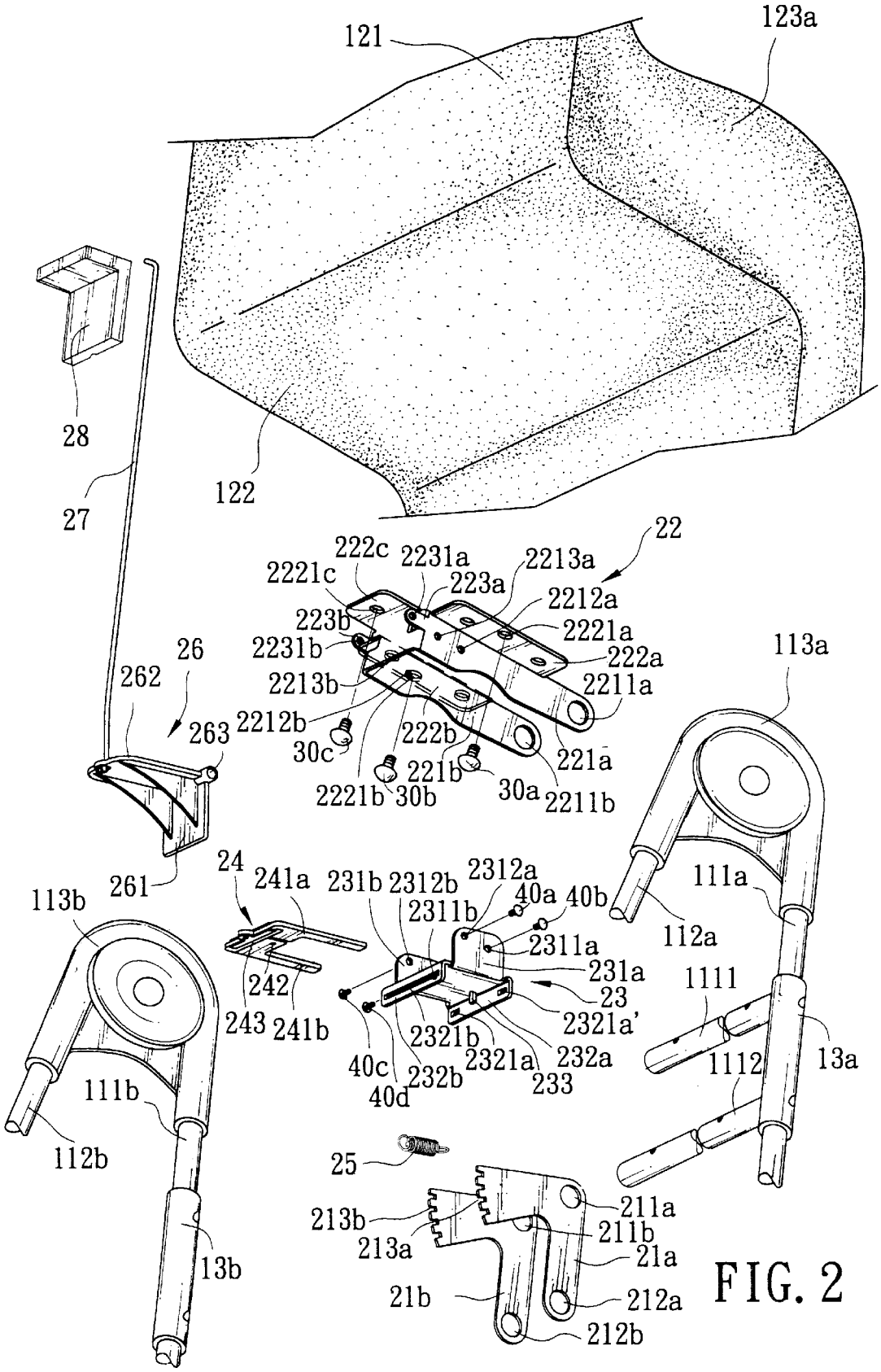
FIG. 2 is an exploded view of the FIG. 1 mechanism.
Figure 3:
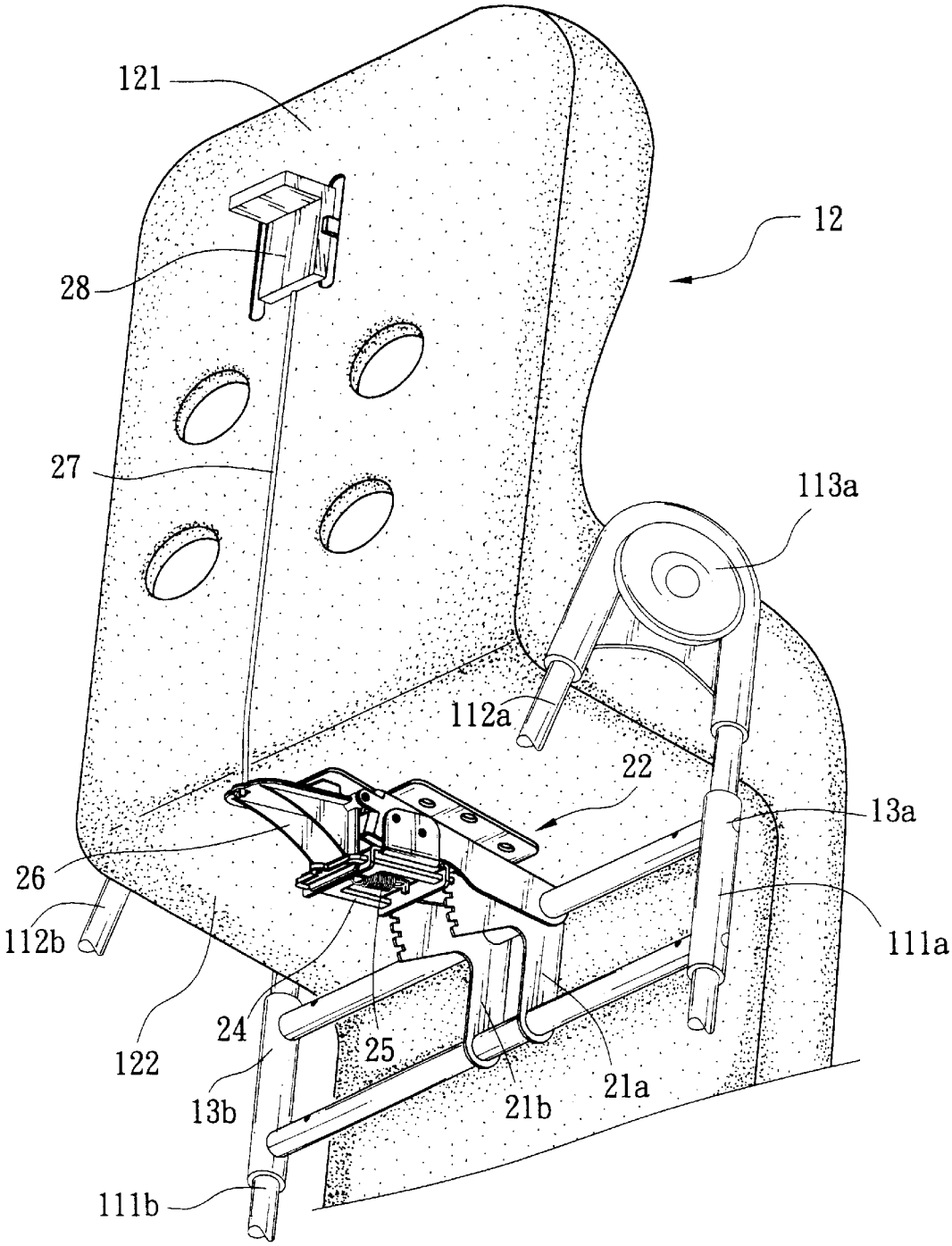
FIG. 3 is a schematic perspective view of the assembled FIG. 2 mechanism.

Referring to FIGS. 1 to 3, there is shown a highchair incorporating an oblique angle adjustment mechanism constructed in accordance with the invention. Highchair comprises a frame 11 and a seat 12. Frame 11 comprises a pair of front legs 111*a*, 111*b*, *a* pair of rear legs 112*a*, 112*b*, and a pair of hinges 113*a*, 113*b* adjoined front leg 111*a*, rear leg 112*a* and front leg 111*b*, rear leg 112*b* respectively wherein front leg 111*a*, front leg 111*b* both are at an acute angle with respect to rear leg 112*a*, rear leg 112*b* respectively. Horizontal extensions 114, 115 are coupled between the bottom ends of front legs 111*a*, 111*b* and the bottom ends of rear legs 112*a*, 112*b* respectively. Wheels 1141*a*, 1141*b*, 1151*a*; and 1151*b* are pivotably provided on the lower ends of front legs 111*a*, 111*b* and rear legs 112*a*, 112*b* respectively. As such, highchair may move on a supporting surface by means of wheels 1141*a*, 1141*b*, 1151*a*, and 1151*b*. Sleeves 13*a*, 13*b* for adjusting height of seat 12 are put on front legs 111*a*, 111*b* near hinges 113*a*, 113*b* respectively. First connection tube 1111 and second connection tube 1112 are parallel coupled between sleeves 13*a* and 13*b*. Seat 12 comprises a back portion 121, a seat portion 122, arms 123*a*, 123*b*, and foot rest 124.

Referring to FIGS. 2 and 3 specifically, the angle coupled mechanism 20 comprises a pair of positioners 21*a*, 21*b*, a base 22, a guide member 23, a latched member 24, an elastic member 25, a control member 26, a connection cable 27, and an actuation member 28. Each of above components is detailed below.

Each of positioners 21*a*, 21*b* is L shape. Positioner 21*a* comprises holes 211*a* and 212*a* at the corner and in the end of the vertical portion respectively and an arc-shaped notched member (with respect to the corner of the positioner 21*a*) having a plurality of notches 213*a* in the end of horizontal portion, while positioner 21*b* comprises holes 211*b* and 212*b* at the corner and in the end of the vertical portion respectively and an arc-shaped notched member (with respect to the corner of the positioner 21*b*) having a plurality of notches 213*b* in the end of horizontal portion. The serially connected notches Second connection tube 1111 is inserted through holes 211*a*, 211*b* and second connection tube 1112 is inserted through holes 212*a*, 212*b* respectively. As such, positioners 21*a*, 21*b* are secured to first connection tube 1111, second connection tube 1112 respectively.

Base 22 is generally a U comprising two first engagement members 221*a*, 221*b* having end holes 2211*a*, 2211*b* respectively. First engagement members 221*a*, 221*b* further comprise apertures 2212*a*, 2213*a* and 2212*b*, 2213*b* respectively. Wings 222*a* and 222*b* are extended outward from sides of first engagement members 221*a*, while wing 222*c* is provided between first engagement members 221*a* and 221*b*. Each of wings 222*a*, 222*b*, and 222*c* comprises a plurality of holes 2221*a*, 2221*b*, and 2221*c* respectively. Second engagement members 223*a*, 223*b* are extended from first engagement members 221*a*, 221*b* opposing end holes 2211*a*, 2211*b* respectively. Hole 2231*a*, 2231*b* are provided on second engagement members 223*a*, 223*b* respectively. Wings 222*a*, 222*b*, and 222*c* are secured to the underside of seat portion 122 by threading a plurality of screws 30*a*, 30*b*, and 30*c* through holes 2221*a*, 2221*b*, and 2221*c* respectively and seat portion 122. Also, end holes 2211*a*, 2211*b* of first engagement members 221*a*, 221*b* are pivotably disposed around first connection tube 1111 respectively. As such, seat 12 may pivot about first connection tube 1111.

Guide member 23 is generally a U comprising two opposed upper side plates 231*a*, 231*b* corresponding to first engagement members 221*a*, 221*b* of base 22 respectively. Side plate 231*a* comprises a plurality of holes 231*a*, 2312*a* corresponding to apertures 2212*a*, 2213*a* of first engagement members 221*a* respectively, while side plate 231*b* comprises a plurality of holes 2311*b*, 2312*b* corresponding to apertures 2212*b*, 2213*b* of first engagement members 221*b* respectively. Guide member 23 further comprises two opposed lower guide plates 232*a*, 232*b* between side plates 231*a*, 231*b* respectively. A slot 2321*b* is provided on guide plate 232*b*, while two spaced slots 2321*a*, 2321*a*' are provided on guide plate 232*a*. A stud 233 is provided between slots 2321*a* and 2321*a*'. Guide member 23 is secured to base 22 by inserting a plurality of rivets 40*a*, 40*b*, 40*c*, and 40*d* through holes 2311*a*, 2312*a* of side plate 231*a* and holes 2311*b*, 2312*b* of side plate 231*b* respectively as well as through apertures 2212*a*, 2213*a* of first engagement member 221*a* and apertures 2212*b*, 2213*b* of first engagement member 221*b* respectively. Guide member 23 is secured between positioners 21*a* and 21*b* such that slots 2321*a*, 2321*a*' are disposed corresponding to notches 213*a*, 213*b*.

Latched member 24 is generally a U comprising two uprights 241*a*, 241*b* inserted into slots 2321*a*, 2321*a*' respectively, a hole 242, and slot 243 both between uprights 241*a* and 241*b*. Latched member 24 is slidably provided in slots 2321*a*, 2321*a*', and 2321*b* of guide member 23.

Elastic member 25 has one end coupled to stud 233 of guide member 23 and the other end coupled to end coupled to hole 242 of latched member 24. As such, uprights 241*a*, 241*b* are extended through slots 2321*a*, 2321*a*' to engage with notches 213*a*, 213*b* of positioners 21, 21*b* respectively by virtue of elastic member 25, thereby inhibiting the rotation of seat 12. User may pull latched member 24 rearward to urge against the elastic member 25 to move uprights 241*a*, 241*b* out of engagement of notches 213*a*, 213*b*. As a result, seat 12 is in an operating position.

Control member 26 is generally an L comprises a vertical plate 261, a horizontal plate 262, and a pin 263 pivotably secured the vertical plate 261 and the horizontal plate 262 together. Also, pin 253 of control member 26 is pivotably secured to holes 2231, 2231*b* of second engagement members 223*a*, 223*b*. Further, the vertical plate 261 is extended through slot 243 of latched member 24. In use, pull the horizontal plate 262 upward to cause the vertical plate 261 to move outward which in turn pulls latched member 24 outward to the operating position.

Actuation member 28 is provided on the outer surface of the back portion 121 of seat 12. Connection cable 27 is coupled between the horizontal plate 262 and actuation member 28. As such, operator may manipulate the angle adjustment in a convenient position.

Figure 4A:
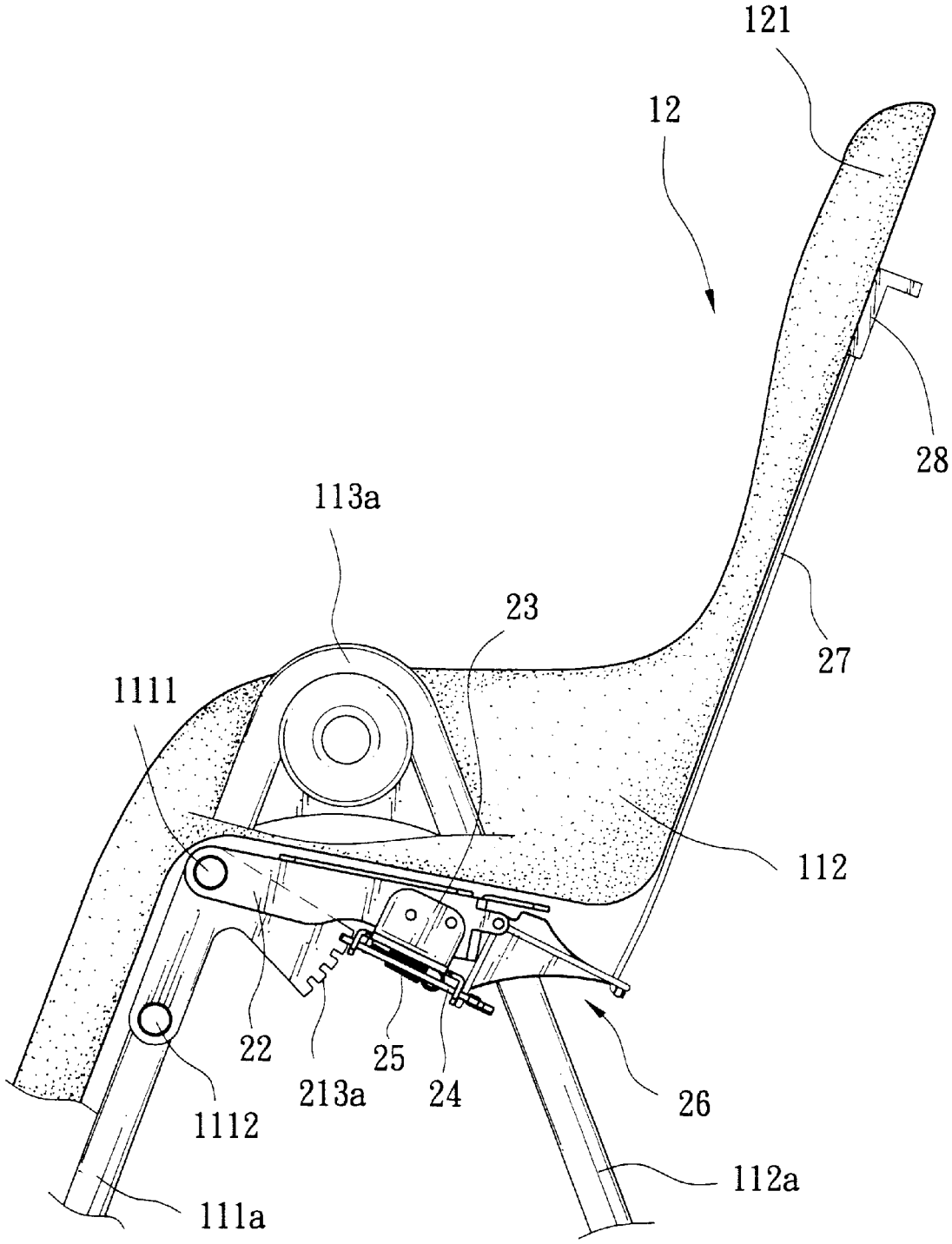
FIG. 4A, 4B, 4C are side views illustrating the operation of the FIG. 3 mechanism.
Figure 4B:
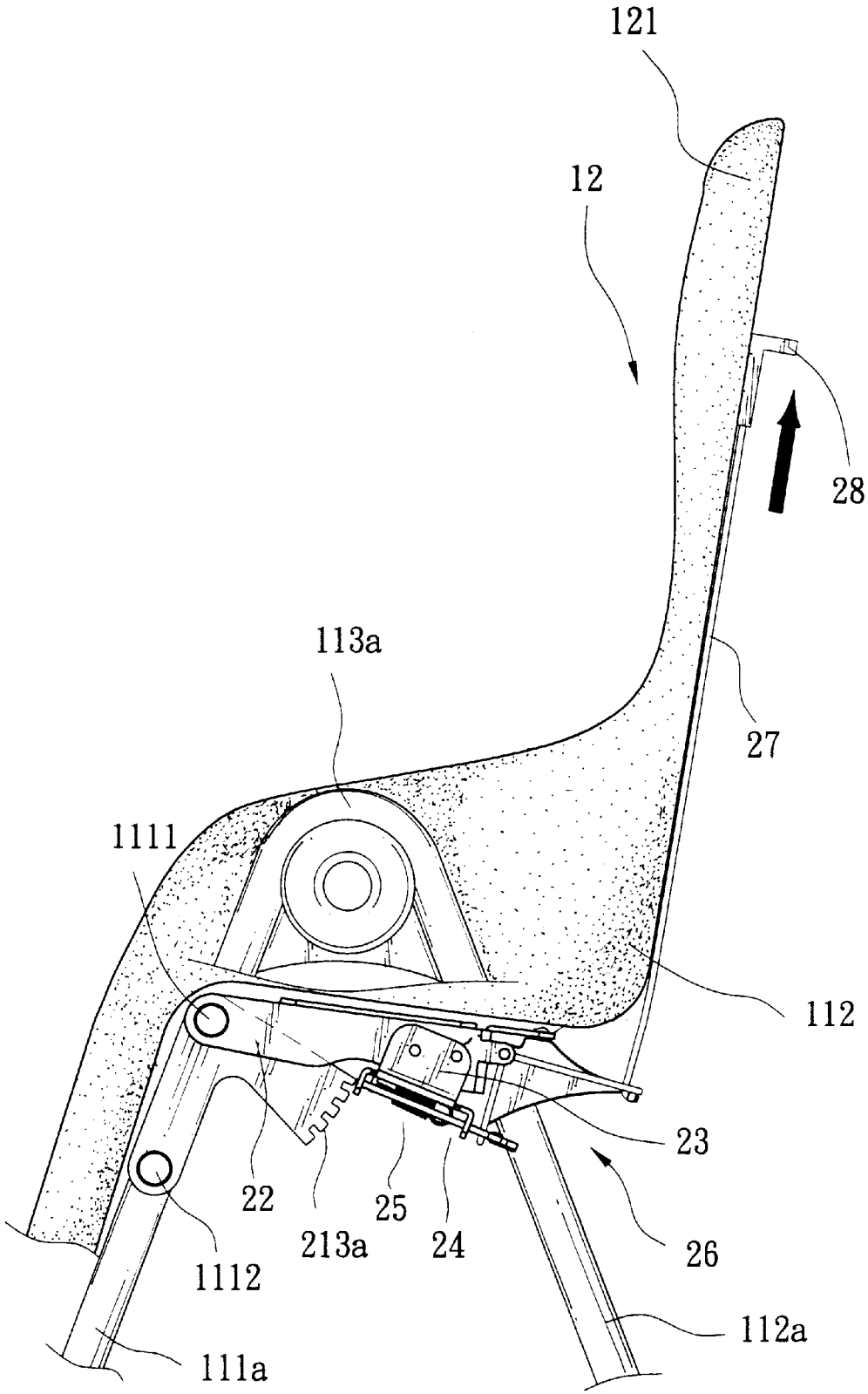
Figure 4C:
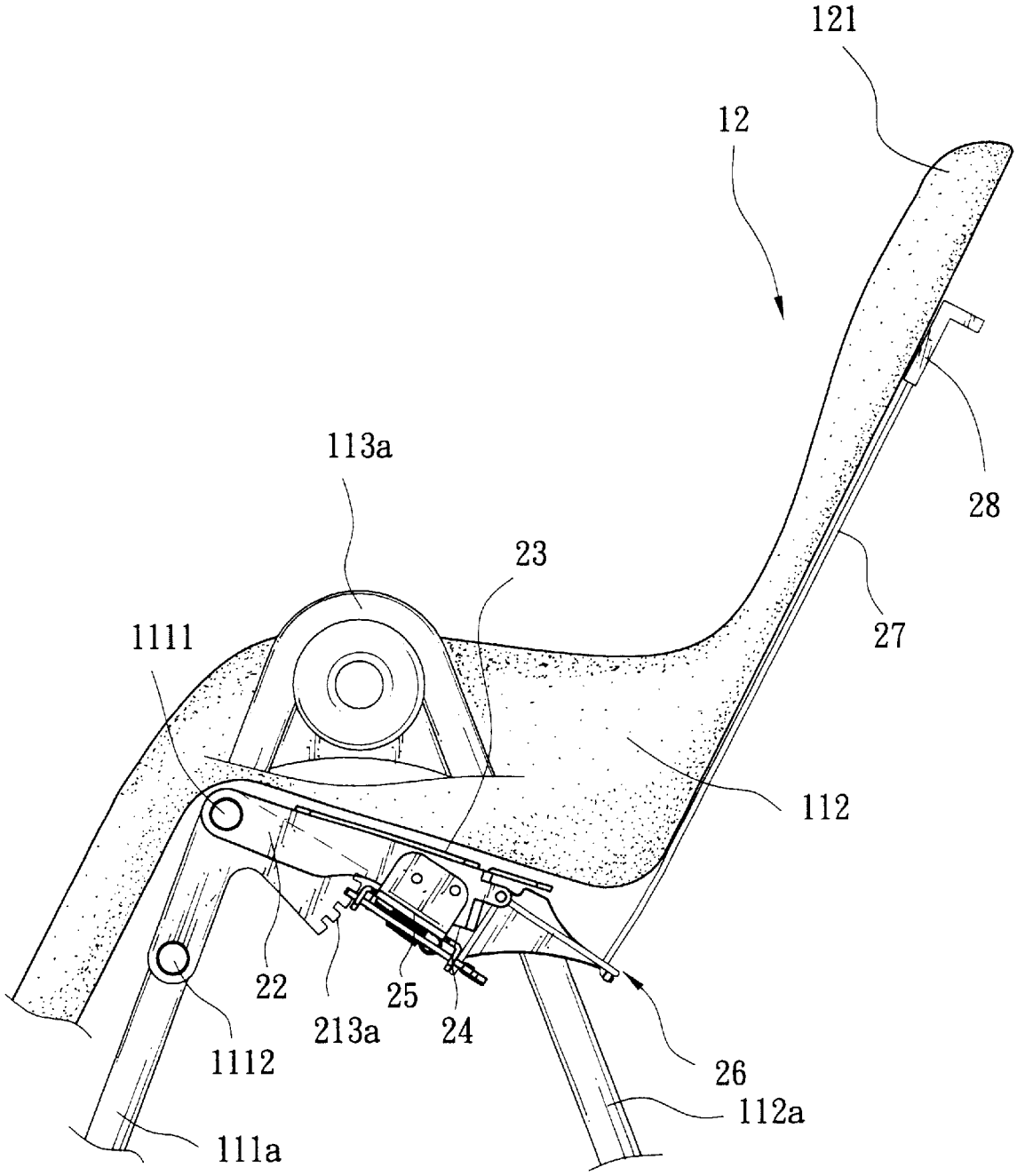

Referring to FIGS. 4A and 4B, seat 12 is pivotable about first connection tube 1111 of frame 11 through the engagement of base 22 and first connection tube 1111. Further, the height of seat 12 is adjustable by manipulating sleeves 13*a*, 13*b* along front legs 111*a*, 111*b*. In a locked position, seat 12 is immovably secured to frame 11 wherein uprights 241*a*, 241*b* are engaged with notches 213*a*, 213*b* of positioners 21. In adjusting the angle of seat 12, pull actuation member 28 for pulling connection cable 27 and actuating the control member 26 accordingly. And in turn latched member 24 is pulled outward to cause uprights 241*a*, 241*b* to disengage from notches 213*a*, 213*b* of positioners 21. As such, seat 12 may pivotably move about first connection tube 1111 until a desired angle is reached. At this time, release actuation member 28 which in turn instantly causes latched member 24 to return to its original position by virtue of elastic member 25. As a result, latched member 24 is again engaged with notches 213*a*, 213*b* of positioners 21, thus locking seat 12 in that angle.

Note that the provision of connection cable 27 and actuation member 28 is simply for the sake of convenience. Operator may directly manipulate control member 26 to adjust the angle of seat 12. Also, two positioners 21 may be formed as one positioner as long as capable of engaging with latched member 24.

Figure 5:
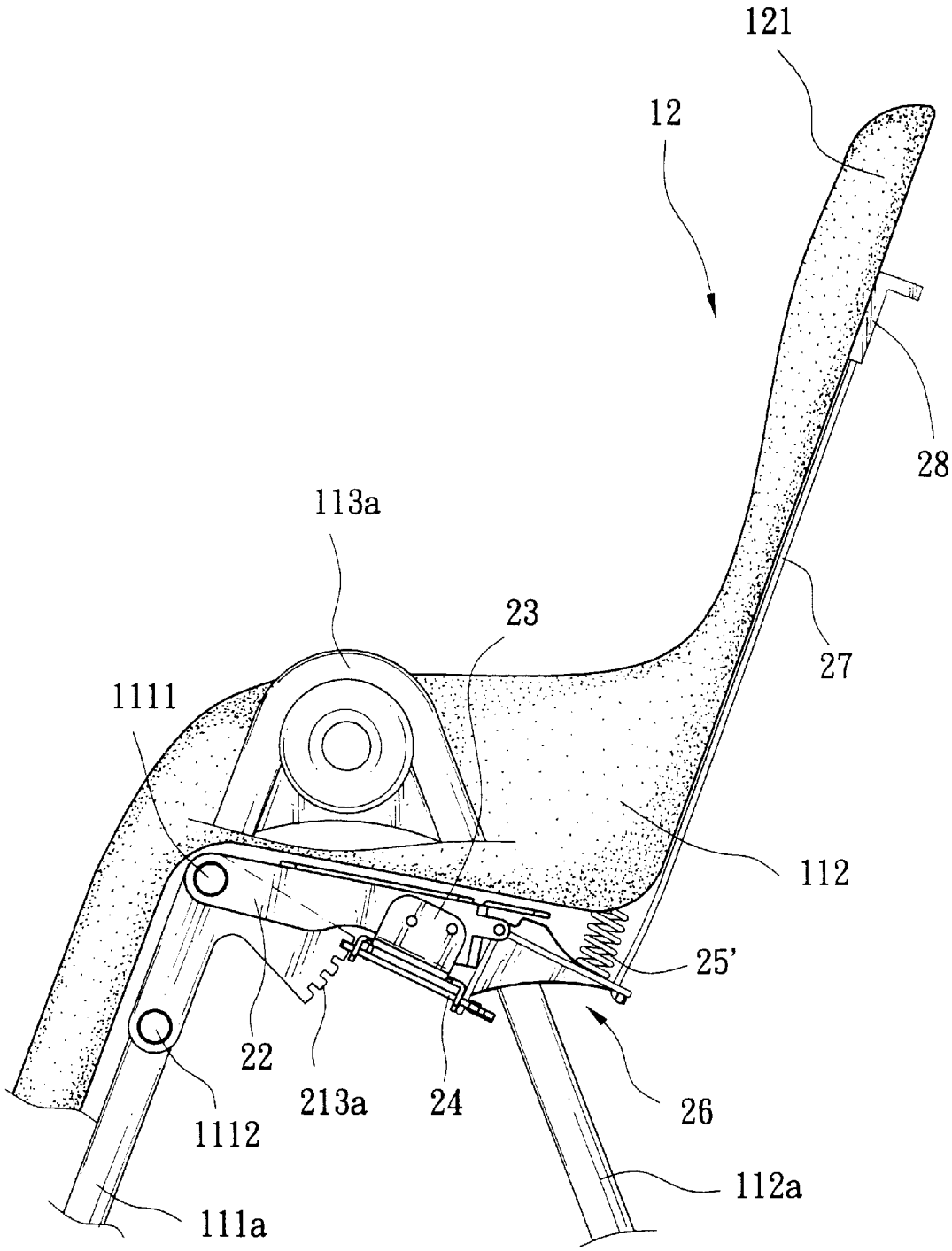
FIG. 5 is a side view of a highchair incorporating a second preferred embodiment of angle adjustment mechanism according to the invention.

Referring to FIG. 5, there is shown a second preferred embodiment of the invention. It is designed in the first preferred embodiment that elastic member 25 has one end coupled to stud 333 of guide member 23 and the other end coupled to hole 242 of latched member 24. In comparison, elastic member 25' of the second preferred embodiment is anchored between underside of seat 12 and control member 26. It is also possible to lock latched member 24 or move latched member 24 for achieving the angle adjustment purpose.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A highchair having a frame, a seat pivotably secured to the frame, and an angle adjustment mechanism for the seat, the angle adjustment mechanism comprising:

a positioner attached to the seat including a notched member having a plurality of notches;

a base provided beneath the seat being pivotable about the frame including an elastic member and a movable latched member attached to the elastic member capable of being engaged with the notch of the positioner in a locked position of the seat or being actuated to disengage from the notch of the positioner in an operating position of the seat for adjusting the angle of the seat; and a control member movably attached to the base and attached to the latched member for controlling the movement of the latched member.

2. The highchair of claim 1, wherein the seat comprises a back portion, a seat portion, two arms, and a foot rest.

3. The highchair of claim 1, wherein the frame comprises a pair of front legs, a pair of rear legs, and a pair of hinges.

4. The highchair of claim 3, wherein each hinge is adjoined by the top ends of one front leg and one rear leg, and further comprising a pair of horizontal extensions wherein one horizontal extension is coupled between the bottom ends of the front legs and the other horizontal extension is coupled between the bottom ends of the rear legs, and four wheels on the lower ends of the front and the rear legs respectively.

5. The highchair of claim 3, further comprising two sleeves put on the front legs respectively for adjusting the height of the seat.

6. The highchair of claim 5, further comprising a first connection tube and a second connection tube coupled between the sleeves.

7. The highchair of claim 1, wherein each positioner is an L shape comprising a first hole at the corner with a first connection tube inserted therethrough and a second hole in the end of the vertical portion with a second connection tube inserted therethrough.

8. The highchair of claim 1, wherein the notched member is an arc with respect to a corner of the positioner.

9. The highchair of claim 1, wherein the base comprising:

a pair of first engagement members each having an end hole;

a plurality of wings wherein one wing is provided between the first engagement members and the other wings are extended outward from the sides of the first engagement members; and a pair of second engagement members each extended from the first engagement member opposing the end hole of the first engagement member, each second engagement member comprising a third hole.

10. The highchair of claim 9, wherein each wing comprises a plurality of fourth holes such that the wings are secured to the seat by threading a plurality of screws through the fourth holes and the seat.

11. The highchair of claim 9, wherein the first engagement members are pivotably disposed around a first connection tube by inserting the first connection tube through the end holes.

12. The highchair of claim 1, further comprising a guide member being movable with respect to the latched member.

13. The highchair of claim 12, wherein the guide member comprises a plurality of slots for permitting the latched member to insert in.

14. The highchair of claim 1, wherein the latched member comprises a slit for permitting the control member to move in.

15. The highchair of claim 1, further comprising an actuation member on the outer surface of the seat and a connection cable coupled between the control member and the actuation member.

16. A highchair having a frame, a seat pivotably secured to the frame, and an angle adjustment mechanism for the seat, the mechanism comprising:

a positioner attached to the seat including a notched member having a plurality of notches;

a base provided beneath the seat being pivotable about the frame including a guide member, an elastic member anchored in the guide member, and a movable latched member capable of being engaged with the notch of the positioner in a locked position of the seat or being actuated to disengage from the notch of the positioner in an operating position of the seat for adjusting the angle of the seat;

a control member movably attached to the base and attached to the latched member for controlling the movement of the latched member;

an actuation member on the outer surface of the seat; and a connection cable coupled between the control member and the actuation member.

17. The highchair of claim 16, wherein the latched member comprises a slit for permitting the control member to move in.

18. A highchair having a frame, a seat pivotably secured to the frame, and an angle adjustment mechanism for the seat, the mechanism comprising:

a positioner attached to the seat including a notched member having a plurality of notches;

a base provided beneath the seat being pivotable about the frame having a movable latched member capable of being engaged with the notch of the positioner in a locked position of the seat or being actuated to disengage from the notch of the positioner in an operating position of the seat for adjusting the angle of the seat; and a control member movably attached to the base and attached to the latched member having an elastic member provided between the underside of the seat and the control member, thereby controlling the movement of the latched member.

* * * * *